US005956972A

United States Patent [19]

Naumovitz

[11] Patent Number: 5,956,972

[45] Date of Patent: Sep. 28, 1999

[54] METHOD OF OPERATING A LOWER PRESSURE COLUMN OF A DOUBLE COLUMN DISTILLATION UNIT

[75] Inventor: Joseph P. Naumovitz, Lebanon, N.J.

[73] Assignee: The BOC Group, Inc., New Providence, N.J.

[21] Appl. No.: 08/997,019

[22] Filed: Dec. 23, 1997

[51] Int. Cl.[6] ..... F25J 1/00

[52] U.S. Cl. ..... 62/643; 62/656; 62/903; 202/158

[58] Field of Search ..... 62/643, 903, 905, 62/656; 202/158

[56] References Cited

U.S. PATENT DOCUMENTS 4,337,070 6/1982 Rohde ..... 62/903
5,071,458 12/1991 Grenier et al. ..... 62/903

*Primary Examiner*—Ronald Capossela
*Attorney, Agent, or Firm*—David M. Rosenblum; Salvatore P. Pace

[57] ABSTRACT

A method of operating a lower pressure of column of a double distillation column unit. In accordance with the method an ascending vapor phase is initiated within a lower pressure column by vaporizing a descending liquid phase at a column location situated between mass transfer elements and a sump region of the lower pressure column. The liquid phase is vaporized within two or more down-flow reboilers fed with the liquid phase so that the unboiled liquid from one of the down-flow reboilers is fed to another of the down-flow reboilers, thereby to cause vaporization to be distributed between the down-flow reboilers. The down-flow reboilers are configured such that sufficient vaporization occurs to produce a predetermined liquid-vapor ratio at the column location between the transfer elements and the sump without the requirement of recirculating sump liquid to prevent dry out.

5 Claims, 1 Drawing Sheet

FIG.
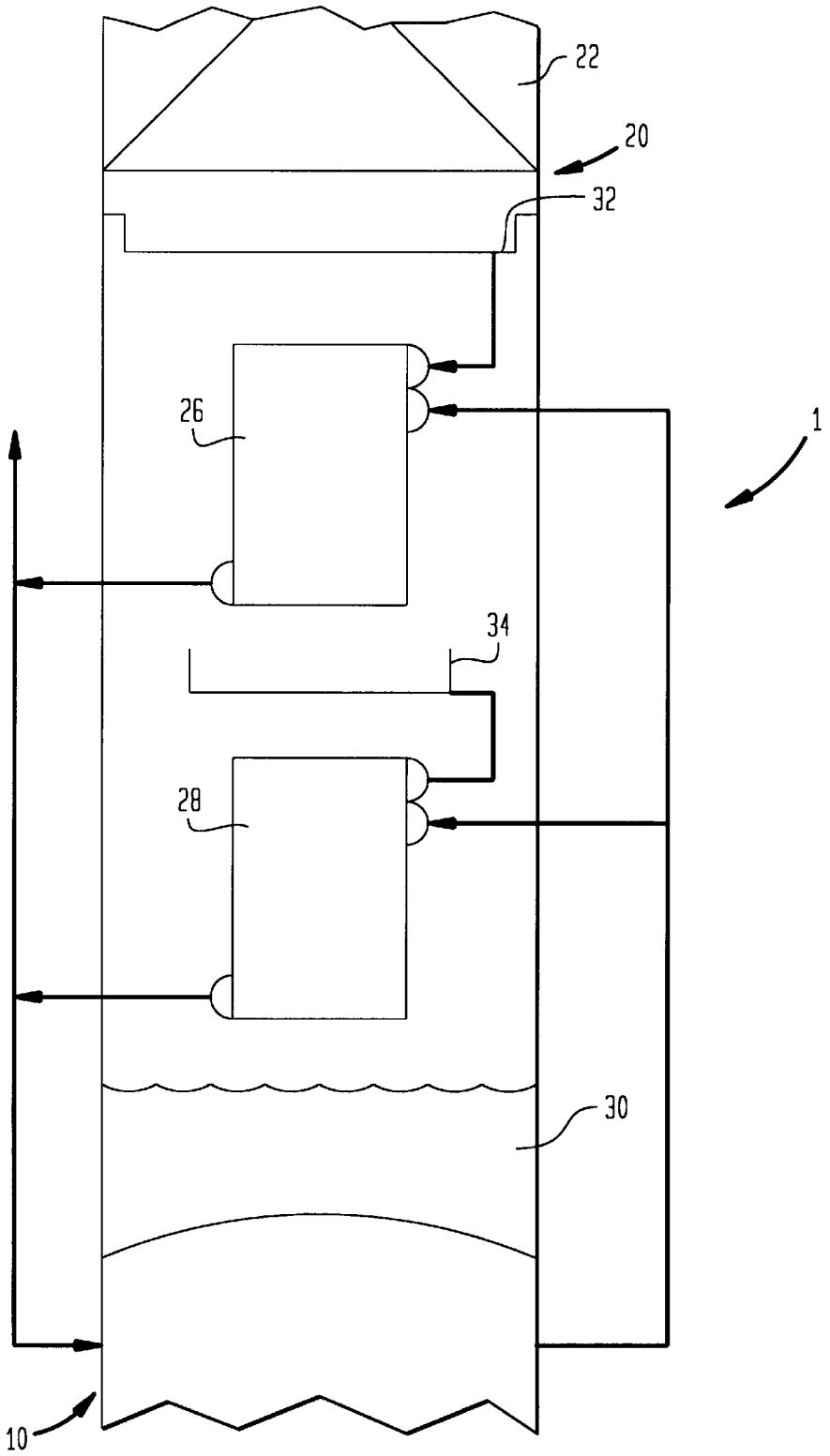

METHOD OF OPERATING A LOWER PRESSURE COLUMN OF A DOUBLE COLUMN DISTILLATION UNIT

BACKGROUND OF THE INVENTION

The present invention relates to a method of operating a lower pressure column of a double column distillation unit in which mixture is distilled within the lower pressure column by contacting an ascending vapor phase with a descending liquid phase the use of mass transfer elements. More particularly, the present invention relates to such a method in which the ascending vapor phase is initiated through vaporization of liquid within down flow reboilers. Even more particularly, the present invention relates to such a method in which vaporization of the liquid is distributed between two or more down-flow reboilers to produce a predetermined liquid to vapor ratio and without recirculation of sump liquid back to the down-flow reboilers.

Various mixtures are distilled within distillation column units having a higher pressure distillation column operatively associated with a lower pressure distillation column in a heat transfer relationship. The mixture to be distilled is processed within the higher pressure column and then is further processed within the lower pressure column. A typical example of such distillation is the low temperature rectification of air. Air is rectified by cooling a stream of compressed and purified air to a temperature suitable for its rectification. The air stream after having been cooled is introduced into a higher pressure distillation column to produce a nitrogen tower overhead and an oxygen-enriched liquid column bottoms. The liquid column bottoms introduced into a lower pressure column for further processing to produce a nitrogen rich tower overhead and an oxygen-rich liquid column bottoms. The oxygen-rich column bottoms can be taken as a liquid oxygen product or a vapor product that is pumped to a delivery pressure before being vaporized.

In both the higher and lower pressure columns, ascending vapor phases and descending liquid phases of the mixture to be distilled are produced. These vapor and liquid phases are contacted by mass transfer elements such as structured packing, random packing or trays. In the lower pressure column, nitrogen-rich vapor from the tower overhead region of the higher pressure column is condensed against the vaporization of the liquid column bottoms produced in the lower pressure column. The vaporization of the liquid in the lower pressure column initiates formation of the ascending vapor phase while the condensate formed by condensation of the nitrogen-rich vapor is recirculated back to both higher and lower pressure columns to initiate formation of the descending liquid phases. Alternatively a liquefying air stream can be used to vaporize the liquid in the low pressure column.

In order for the nitrogen-rich tower overhead to condense the liquid oxygen column bottoms, a temperature difference must be maintained. The narrowness of the temperature difference that can be maintained can depend upon the specific configuration or type of condenser-reboiler used within the lower pressure column. It has been found that down flow reboilers provide very narrow temperature difference. This is important because the lower the temperature difference to be maintained between the nitrogen to be condensed versus the oxygen to be vaporized, the lower the pressure within the higher pressure column and hence, the lower the pressure need be upon compression of the air.

The down flow reboilers that are used for such purposes are also referred to in the art as falling film devices in that a falling film of the liquid is initiated within heat exchange passages. As is well known in the art, down flow reboilers or falling film devices consist of a plurality of parallel plates to form the heat exchange passages. Generally, sheets of corrugated fin material are located within the heat exchange passages to increase the surface area of the heat exchanger and therefore the heat transfer capability of the heat exchanger.

The draw back in the use of down flow reboilers, particularly in the case of air separation, is that heavy contaminants such as hydrocarbons tend to concentrate in the liquid to be vaporized, for instance, liquid oxygen. Since a mixture of hydrocarbons and oxygen is potentially dangerous, such reboilers are operated to only vaporize part of the liquid, such as oxygen, to prevent dryout of the heat exchange passages and collection of hydrocarbons thereon. The remaining part of the liquid to be vaporized is supplied by recirculating sump liquid to the reboiler by pumping the sump liquid. The disadvantage of such operation is not only that a pump must be supplied, operated and powered, but also additional pumping energy imparted to the sump liquid must be compensated for by increased refrigeration and therefore increased power outlays in operating the plant.

As will be discussed, the present invention provides a method of operating a lower pressure column of a double column distillation unit in which all of the liquid is vaporized within down flow reboilers without the necessity of there being any pumping.

SUMMARY OF THE INVENTION

In accordance with the invention, a method is provided for operating a lower pressure column of the double distillation column unit. The method comprises initiating an ascending vapor phase within the lower pressure column by vaporizing a descending liquid phase at a column level situated between mass transfer elements used in contacting the vapor and liquid phases and a sump region of the lower pressure column. The liquid phase is vaporized within at least two down-flow reboilers fed with the liquid phase such that unboiled liquid from one of the down-flow reboilers is fed to another of the down-flow reboilers, thereby to cause vaporization to be distributed between the two down-flow reboilers. The at least two down flow reboilers are configured such that sufficient vaporization occurs to produce a predetermined liquid-vapor ratio at the column location without sump liquid from the sump region being recirculated back to the least two down flow reboilers.

As it is apparent, by distributing the vaporization of the liquid within multiple down-flow reboilers, all of the liquid that is required to be vaporized within the down flow reboilers can vaporized without the necessity of there being any pumps to recirculate liquid for vaporization.

BRIEF DESCRIPTION OF THE DRAWINGS

While the specification concludes with claims distinguishably pointing out the subject matter that Applicants regard as their invention, it is believed the invention will be better understood when taken in connection with the accompanying drawings in which the sole FIGURE is a schematic representation of a apparatus for carrying out a method in accordance with a present invention.

DETAILED DESCRIPTION

With reference to the FIGURE, a double distillation column unit 1 is illustrated having a higher pressure column 10 and a lower pressure column 20. Lower pressure column 20 contains mass transfer elements 22 which can be structured packing, random packing or trays. Mass transfer elements 22 function to bring the ascending vapor phase into intimate contact with the descending liquid phase as a known, predetermined ratio of liquid to vapor. Thus, if the liquid vapor ratio is 1.4, then approximately 1.4 units of liquid must be descending against 1 unit of vapor ascending.

In order to initiate formation of the ascending vapor phase, two down flow reboilers 30 and 40 are illustrated. The liquid that is not condensed within down flow reboilers 30 and 40 collects within a sump region 30 of lower pressure distillation column 20.

Liquid descending within lower pressure column 20 is collected within a liquid collector 32 where it is partially vaporized within a down flow reboiler 26. The liquid not vaporized is caught within collector 34. Liquid caught in collector 34 is then routed to down flow reboiler 28. The liquid is then partly vaporized within down flow reboiler 28 and the remaining liquid collects within sump region 30. Alternatively, both downflow reboilers can be one unit with appropriate vapor disengagement and liquid redistribution within the same unit.

Nitrogen-rich tower overhead from higher pressure column 10 is fed to down flow reboilers 26 and 28, in parallel, where such nitrogen-rich tower overhead condenses to produce liquid nitrogen. Part of the liquid nitrogen is returned to higher pressure column 10 and another portion is used as reflux to lower pressure column 20. Such reflux initiates formation of the descending liquid phase.

Downflow reboilers 26 and 28 are designed in a known manner to function at a specific duty so that vaporization of the down flowing liquid is distributed. Thus, assuming a liquid to vapor ratio of 1.4, Downflow reboiler 26 can be designed so that for each 1.4 units of liquid that are introduced from collector 32,0.7 units vaporize and 0.7 units are caught in collector 34. The 0.7 units that are collected within collector 34 are then routed to down flow reboiler 28 designed so that half of 0.7 units vaporize and the remaining half collects within some sump region 30. This produces a total vaporization of about 1.05 units to produce the required liquid to vapor ratio. Therefore, the required vaporization occurs without the necessity of there being any pumping of liquid from sump region 30.

While the present invention has been described with reference to a preferred embodiment, as will occur to those skilled in the art, numerous changes, additions and omission can be made be made without departing from the spirit and scope by the present invention.

I claim:

1. A method of operating a lower pressure column of a double distillation column unit, said method comprising:

initiating an ascending vapor phase within the lower pressure column by vaporizing a descending liquid phase at a column location situated between mass transfer elements used in contacting said vapor and liquid phases and a sump region of said lower pressure column;

said liquid phase being vaporized within at least two down-flow reboilers fed with said liquid phase such that unboiled liquid from one of said down-flow reboilers is fed to another of said down-flow reboilers, thereby to cause vaporization to be distributed between said at least two down-flow reboilers;

the at least two down-flow reboilers configured such that sufficient vaporization occurs to produce a predetermined liquid-vapor ratio at said column location without sump liquid from said sump region being recirculated back to said at least two down-flow reboilers.

2. The method of claim 1, wherein said double distillation column unit is employed to distill air and therefore said ascending vapor phase becomes ever richer in nitrogen as it ascends and said descending liquid phase becomes ever richer in oxygen as it descends.

3. The method of claim 2, wherein nitrogen rich vapor is removed from a higher pressure column of said double distillation column unit and condensed against vaporizing said liquid phase.

4. The method of claim 1, wherein said liquid-vapor ratio is about 1.4.

5. The method of claim 2, where a stream of said sump liquid is removed from said sump and pumped to a delivery pressure.

* * * * *